United States Patent [19]

Zenkner

[11] Patent Number: 4,491,171

[45] Date of Patent: Jan. 1, 1985

[54] REGENERATOR WITH A ROTATING REGENERATIVE HEAT EXCHANGER

[75] Inventor: Kurt Zenkner, Karlsruhe, Fed. Rep. of Germany

[73] Assignee: Firma Wilhelm Gebhardt GmbH, Waldenburg, Fed. Rep. of Germany

[21] Appl. No.: 287,629

[22] Filed: Jul. 28, 1981

(Under 37 CFR 1.47)

[30] Foreign Application Priority Data

Jul. 29, 1980 [DE] Fed. Rep. of Germany ..... 3028632

[51] Int. Cl.[3] ..... F28D 19/00

[52] U.S. Cl. ..... 165/7; 165/8; 165/10

[58] Field of Search ..... 165/8, 6, 10, 7

[56] References Cited

U.S. PATENT DOCUMENTS 1,776,172 9/1930 Martinka ..... 165/10
1,843,252 2/1932 Toensfeldt ..... 165/8 X
2,978,227 4/1961 Hess ..... 165/10 X
3,194,301 7/1965 Kovats ..... 165/10 X

FOREIGN PATENT DOCUMENTS 477757 6/1929 Fed. Rep. of Germany ..... 165/8

[57] ABSTRACT

A regenerator with a hollow cylindrical heat exchange roller which is provided with a jacket of heat carrier material with separated flow regions that are passed through by a flow medium emitting heat and a flow medium receiving heat. The hollow cylindrical roller has a partition wall which separates the flow regions. The flow media pass through the regions by substantially radial passages through the jacket and transverse to the axis of rotation of the heat exchange roller. A housing which holds the roller is provided with radial inlet and outlet channels for the flow media. These channels are displaced from one another by substantially 90°.

6 Claims, 11 Drawing Figures

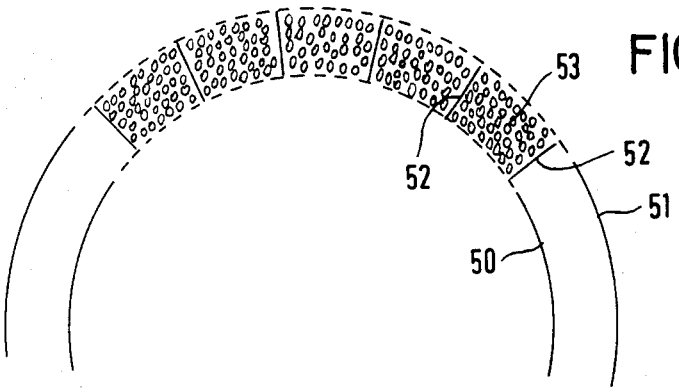
FIG. 5
FIG. 6
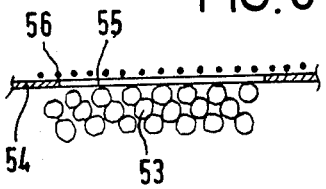
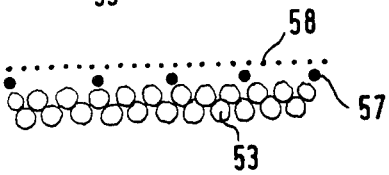
FIG. 7
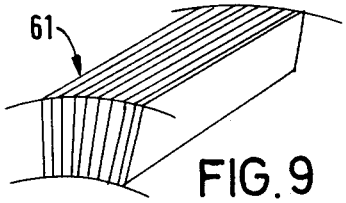
FIG. 9
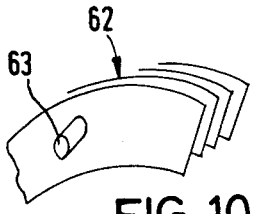
FIG. 10
FIG. 8
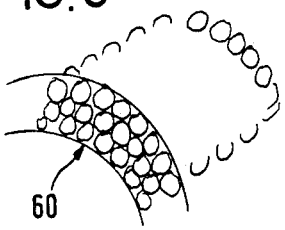
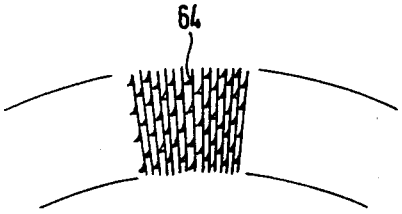
FIG. 11

REGENERATOR WITH A ROTATING REGENERATIVE HEAT EXCHANGER

The invention relates to a regenerator with a regenerative heat exchanger rotating about an axis and having two separated regions through which respective heat supplying and heat receiving medium streams circulate, according to the preamble of claim 1.

A regenerator of this type is already known, in which the heat exchanger is constructed as a circular disk which slowly revolves about an axis of rotation and is filled with heat carrier material in a packing density which is largely uniform over the surface area. In one arcuate half of its rotation an e.g. heat supplying gas stream flows through this circular disk so that the heat carrier material in the disk is heated, whereas in the other arcuate half of the disk rotation a second gas stream, which is separated from the heat supplying gas stream, flows through the disk and absorbs heat. The heat transportation thus takes place via the rotation of the heat carrier disk, the latter flowing hot medium yielding its heat content largely to the heat carrier material and the cold medium becoming heated by flowing along the heated heat carrier material.

Regenerators of this known construction appear in need of improvement. Said regenerators in disk form have only a limited axial extension, but are large in radial direction. They are therefore difficult to integrate in installations. For the predominant types of application, especially in industrial installations, but also in air conditioning installations, flow channels of great depth but of short height are typical. Moreover, the transitions from the as a rule rectangular cross-section system channels to the circular or semi-circular cross-sections in the flow range of the disk-shaped heat exchanger, are expensive and can be realized only by means of flow-dynamically disadvantageous channel-transition pieces. Finally, in the interest of an advantageous utilization of the heat-exchanging mass of the disk flows must be brought as close as possible to the disk diameter separating the media flow, which on the one hand causes problems in the channel guidance and on the other hand leads to an almost complete shielding of the disk journal. Especially the use in high temperature regions therefore confronts the disk-type construction with insuperable problems. A further significant drawback of the known regenerators resides in a temperature distribution in the media flow which is very irregular over the flow cross-section.

In view of these disadvantages of the state of the art the problem to be solved by the invention is to create a regenerator having a rotating regenerative heat exchanger through which separated media streams flow, which in terms of its geometry is simple to install in the channel systems formed in the conventional installations, and which assures an improved heat exchange between at least two media flows, a largely uniform temperature distribution over the cross-section of at least those flow channels carrying the heated flow medium, being assured. Finally, the application limits characterizing the state of the art where the highest temperature range is concerned, are also to be overcome.

Starting from the realization that these partly contradictory requirements can be met only if the heat exchanger to be produced is a product corresponding to the typical channel building forms, which is flat and elongated and has channel connections which are as variable as possible, and further if a heat exchange can be realized which is improved as compared to the simple cross-flow principle, the task of the invention is solved according to the characterizing clause of claim 1 by construction of the regenerator as a cross-flow regenerator with a hollow-cylindrical heat exchange roller turning about an axis of rotation and having a circumferential wall composed of heat carrier material provided with essentially radial flow paths, the inner hollow cylinder being subdivided by a divider wall extending over the entire roller length into two separated flow regions and the separately guided media flows—whose temperatures are different—being made to enter—under passage through the heat carrier material in the roller wall—approximately radially into one of the regions in the rotor which is subdivided by the divider wall and again to leave the region substantially radially through the roller wall.

Thus, in the invention the media flows pass each time twice through the roller wall which accommodates the heat carrier material in the most uniform possible packing density, which naturally must lead to an improved heat exchange between the media streams and the heat carrier material. If the media flows are guided counter to the rotation direction of the rotor under dual flow through the roller wall through a respective region of the rotor interior which is separated by the divider wall, then a heat exchange is assured which is comparable with the operation of the simple cross-flow heat exchanger but which comes close to the counter-flow principle.

The inventive construction of the regenerator with a heat carrier roller, whose wall is penetrated twice by the media flows which are maintained separated in the rotor interior by the divider wall, provides for a regenerator which is simple in construction, inexpensive to produce and which has a high specific heat exchange capability, through which the applicability of such regenerators can be substantially enlarged as compared to the state of the art. Predominantly, the inventive regenerator is characterized by an advantageous adaptability to the requirements of the individual application. For example, the length of the heat exchange roller can be selected in accordance with the depth of the system channels, which naturally facilitates the installation in systems with the typical rectangular channels of low height and great depth. Independently of the selected structural length a largely uniform temperature distribution is obtained in the heated medium flow and there are no objections to use in the high temperature range, at least if according to a special feature temperature sensitive structural elements, such as roller bearings and rotation drive, are arranged remote from the flowed-through regions. In view of the transversely penetrated heat exchange roller it is possible in simple manner to locate bearings and drive outside the flow channel for ready maintenance and in cooled state. By similar or different configuration of the region separated in the rotor interior by the divider wall, the most far ranging capability is made possible to the respectively required media guidance and heat exchange requirements.

The arrangement of the heat exchanger roller in a housing has been found most advantageous, if the housing has channel stubs which are respectively offset by 90° relative to one another, any two associated channel stubs for connection of the channels supplying and removing a medium flow being arranged at one side of the intermediate wall subdividing the rotor interior. If an extremely small leakage rate is required even at higher pressure differences between the medium flows, sealing can be made with sealing strips which, given appropriate material selection, can also handle the high temperature range.

The characteristic of the heat carrier material is of particular importance for the intensity of the heat exchange. In addition to high specific heat, good thermal conductivity and a high specific surface, the use of pourable respectively flowable heat carrier material is of advantage, for example in form of granulate. The layer of heat carrier material, which is accommodated in the roller wall over the surface in the most uniform packing density, may be radially delimited by an inner and an outer cylinder, with these cylinders surrounding one another concentrically under formation of an annular space accommodating the heat carrier material and being provided with flow passages for the gas streams. The cylinders accommodating the heat carrier material between them may also be made of apertured sheet metal, mesh structures or a combination of apertured sheet metal and mesh structures. Between the concentric cylinders radial webs may be arranged at preferably equi-angular spacing to maintain their shape, at distances which are smaller than the width of the housing webs between adjacent housing channels.

Another, particularly important embodiment of the invention provides that the granulate-type heat carrier material is sintered to a hollow cylindrical form, in which case there is no need for cylinders which receive the heat carrier material between them in a predetermined packing density.

Alternatively to the discussed embodiments the heat carrier material may also consist of lamellas which are arranged in the roller wall under formation of radial flow-through gaps. These lamellas may be coaxially arranged circular disks which are anchored in the roller wall approximately midway by carrier bolts extending axially through the disks, or the lamellas may be equi-angularly spaced axially extending sheet-metal webs. In the construction of the wall of the heat carrier roller it is of advantage to provide the lamellas with surface variations extending into the radially extending flow-through gaps, about in form of embossments or deformations extending at a right angle to the surfaces of the lamellas, so as to obtain the strongest possible turbulent flow and their short temperature boundary layers during flow through the roller wall.

Some embodiments of the invention will hereafter be described with reference to the appended drawings. All in schematic views, FIG. 1 shows the principle construction of a regenerator with a rotational heat carrier roller in a sectional view with the section extending normal to the axis of rotation of the roller;

FIG. 5 shows a possible embodiment of the roller wall with the heat exchange material accommodated in maximum-uniformity packing density;

FIG. 6 shows a detail of an imaginable construction of the roller wall;

FIG. 7 shows an alternative to FIG. 6;

FIG. 8 shows a roller wall consisting of granulate sintered to assume roller shape;

FIG. 9 shows an embodiment of the roller wall with lamellas as heat carrier material which are arranged under formation of intermediate gaps;

FIG. 10 shows an alternative embodiment to FIG. 9 with circular disk lamellas; and FIG. 11 shows in a detail view of FIGS. 8 and 9 measures for causing turbulent flows in heat exchange rollers provided with lamellas.

Figure 1:
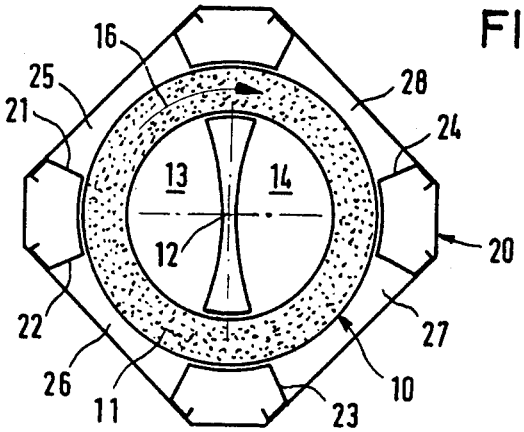

In the regenerator shown in FIG. 1 in a sectional view the heat exchanger is a hollow cylindrical roller 10 of a length which is great in relation to its diameter. The heat exchange roller 10 is turnably received in a housing 20 and provided with a not-illustrated rotary drive for small angular speeds. The heat exchange roller 10 is journalled by means of also not illustrated bearings arranged outside the hollow cylinder by the roller wall 11. Heat carrier material is received in the roller wall 11 in a manner to be described below. Flow paths, extending particularly in radial direction, penetrate the roller wall with the heat carrier material. The inner hollow cylinder of the heat exchange roller 10 is subdivided into two separated regions 13, 14 of respectively semi-cylindrical shape, by means of a divider wall 12 which extends vertically on a diameter line, extends over the entire roller length and is sealed relative to the inner cylinder surface of the roller wall as well as in the region of the roller end faces. The housing 20 has four channel stubs 21, 22, 23, 24 which are each offset through 90° of which two each form at each side of the inner divider wall 12 in- and outflow channels 25, 26 and 27, 28 lying in the hollow cylinder. Connectable to these channels, which extend essentially over the entire length of the heat exchange roller 10, are system channels for the supply and removal of gas streams, as will be discussed below in connection with FIG. 4. At least in the plane defined by the divider wall 12 the gaps between the roller wall 11 and the housing are sealed via not-illustrated sealing strips. Similar, also not-illustrated seals are in the region of the roller end faces.

Typical for the inventive regenerator is that the media flows, between which a heat exchange is to take place via heat carrier material accommodated in the roller wall, each flow twice through the roller wall in approximately radial direction. This is illustrated in different embodiments and diagrammatic views in FIGS. *2a* to *2d*.

FIG. *2b* corresponds to FIG. 1 on omission of the regenerator housing. Let it be assumed that the heat carrier roller 10 rotates according to arrow 16, i.e. in clockwise direction, about its axis of rotation. It is evident that a media flow 30 supplied via the supply channel 25 in housing 20 passes approximately radially through the roller wall and enters into the semi-cylindrical rotor inner space 13, to leave this inner space after another flow through the roller wall in the region of the outflow channel 26 in the housing. A second medium flow 31 is supplied via the supply channel 27 of the housing and also enters after passing through the roller wall 11, into the other semi-cylindrical rotor inner space 14, to be thereafter carried off through the outflow channel 28 after directional deflection and renewed passage through the roller wall. In the rotor interior the two media flows 30, 31 are separated by the divider wall 12. If one assumes that the medium flow 30 supplies heat, then the heat carrier medium accumulated in the roller wall is heated during the dual flow through the wall. In view of the rotation of the heat carrier roller in direction of arrow 16 the roller regions through which the heat supplying medium 30 travels, constantly move across the vertical plane of separation between the two media flows and arrive at flow regions of the medium flow 31 which, when flowing through the previously heated heat carrier material, becomes heated in turn and thus removes heat. The media flows are guided counter to the direction of rotation of the heat exchange roller 10, so that on outflow of the heat-supplying medium stream from the rotor interior 13 a preheating of the heat carrier material takes place and the same is heated to its end temperature in the region of the inflow channel 25. The medium 31, however, which effects heat removal from the heat carrier roller 10, flows through the highly heated heat carrier medium in the region of the outflow channel 28 out of the rotor interior 14 and, after a substantial amount of heat has been removed from the heat carrier material during the mentioned flow-through, enters in the region of the inlet channel 27 whereby, due to the correspondingly low inlet temperature of this medium flow, the heat still contained in this circulation region of the roller wall is withdrawn from the heat carrier material. Due to this dual flow through the roller wall counter to the direction of rotation of the heat exchange roller, an almost counter-flow type of heat transfer is assured in the region of the two flow media flows.

The principle sketch of FIG. 2*a* differs from the embodiment of FIG. 2*a* only in that the inner divider wall 112 is located in a diametral plane extending at an angle of about 45° to the horizontal and that the media flows 130, 131 are each supplied horizontally and flow vertically away from the heat carrier roller 110.

Figure 2:
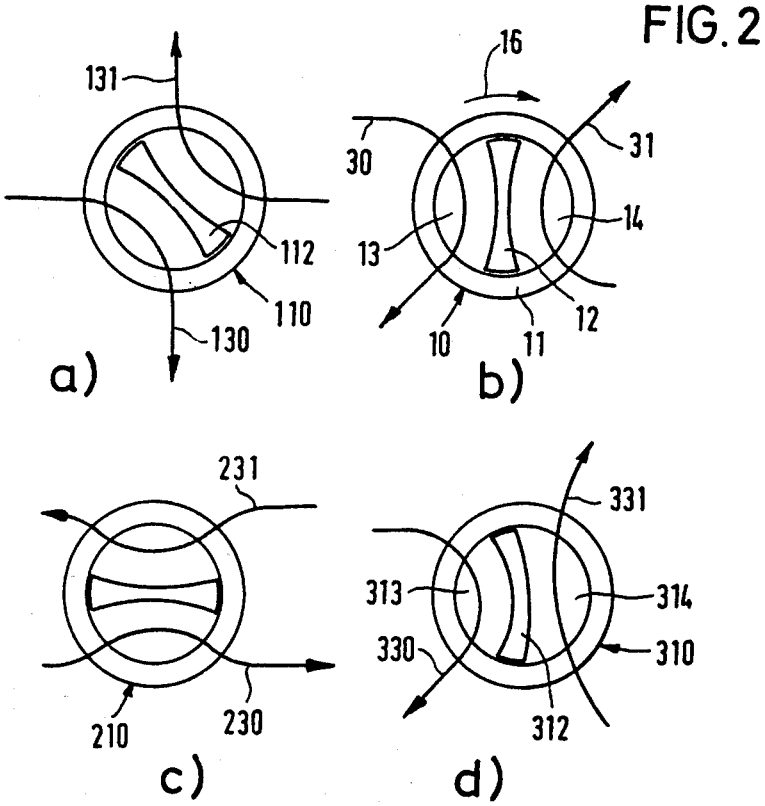
FIG. 2 shows in illustrations a to d alternative possibilities to guide media flows through the separated regions of the heat exchange roller.

FIG. 2 shows that even in the case of media flows 230, 231 which outside the heat exchange roller 210 are guided in alignment, these will each flow twice approximately radially through the roller wall.

The construction according to FIG. 2*d* shows a different subdivision of the inner hollow cylinder of the heat exchange roller 310 by the inner divider wall 312. Insofar the inner rotor spaces 313, 314 extend over different circumferential angles of arc of the roller wall. Nevertheless, in this embodiment also, both media flows 330, 331 each pass twice approximately through the roller wall.

The embodiment in FIG. 2 makes it evident that within the framework of the invention a division of the hollow cylinder of the heat carrier roller into more than two separated inner spaces is also realizable. If necessary, more than two media flows may be utilized which each twice flow through the roller wall, while maintaining the realized flow-through principle.

Figure 3:
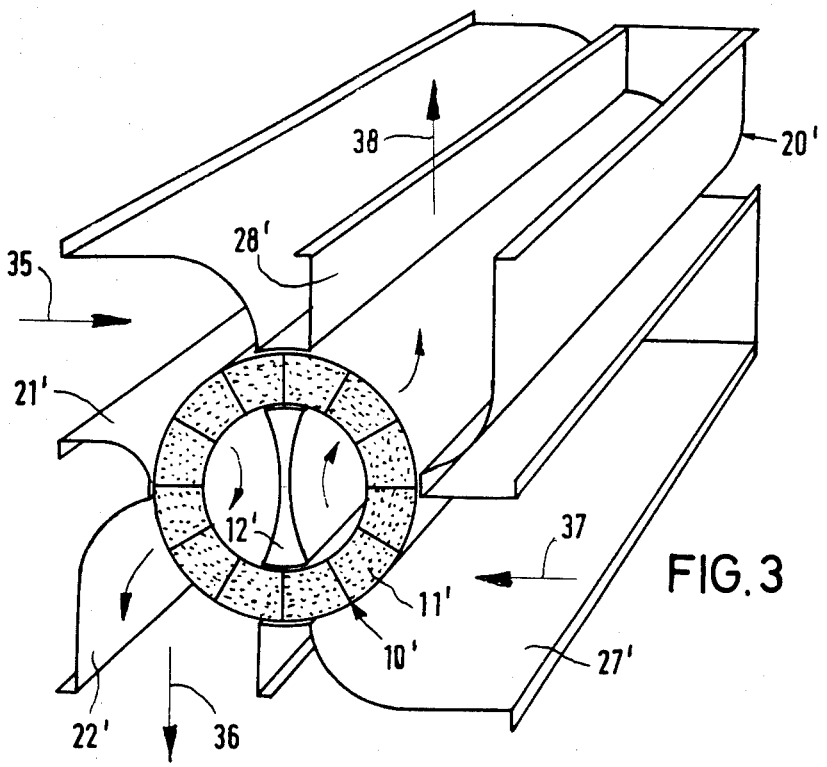
FIG. 3 shows an embodiment of the cross-flow regenerator with media flows which are respectively deflected through 90° on passage through the heat exchange roller, in a perspective sectional view.

FIG. 3 illustrates, in a perspective sectional view, particularly clearly the length of the regenerator which is large in relationship to the diameter of the heat exchange roller 10'. Likewise the channels in housing 20' which serve the supply and removal of the media flows and which have a depth corresponding to about the length of the heat exchange roller at comparatively small dimensions transverse thereto. The inner hollow cylinder of the heat exchange roller is again subdivided via a vertical divider wall into two about semi-cylindrical inner rotor spaces. There medium flow is horizontally supplied according to arrow 35 in the region of the supply channel formed by the channel stub 21' and after passing twice through the wall 11 of the heat exchange roller 10' passes via the outflow channel formed by the channel stub 22' in direction of arrow 36 vertically away from the heat exchange roller. The other medium flow is horizontally supplied in the region of channel stub 27' as per arrow 37 and after passing twice through the roller wall exits vertically upwardly in the region of the channel stub 28' in direction of the arrow 38. In this embodiment, also, a respective dual substantially radial passage through the roller wall is assured.

Figure 4:
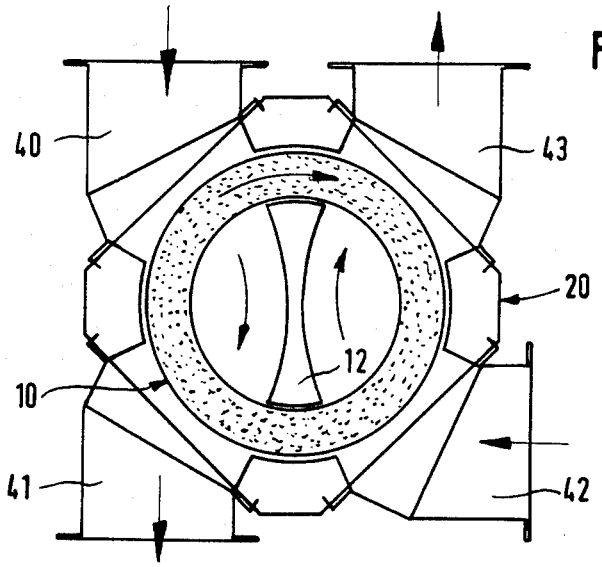
FIG. 4 shows, in a sectional view like FIG. 1, a further alternative for guiding the media streams with flow channels connected to channel stubs of the housing.

FIG. 4 illustrates for the regenerator of FIG. 1 the connection of system channels 40, 41 and 42, 43 to the channel stubs 21, 22 and 23, 24. The system channels 40, 41 serving for the supply and removal of the one medium flow are in alignment, while the system channels 42, 43 serving for the guidance of the other medium flow extend at right angles to one another.

In conjunction with FIGS. 2*a* and 2*d* the FIG. 4 manifold installation possibilities made possible by the inventive regenerator.

The intensity of the heat exchange between a heat carrier material and a medium flow passing through the latter depends on the one hand on the condition of the heat carrier material (especially its heat storage and heat conducting capacity) and on the other hand on the flow type around the heat carrier material. Desirable are the highest possible heat transfer numbers, which are attained by strongly turbulent flows or flow boundary layers of the shortest possible length.

Pourable or flowable materials in spherical or granular form have been found to be excellently suited, which are accommodated in the roller wall of the heat exchange roller in a larger thickness corresponding to the respective application requirements, as shown for example in FIG. 5. The roller wall consists of an outer and an inner cylinder 50, 51 each provided with flow paths, which concentrically surround one another under formation of an annular space and are connected via equiangularly radial webs 52, and of the granulate 53 which is employed as the heat carrier material and which is arranged in the mentioned annular space in the most uniform possible packing density. The distances of the radial webs 52 from one another are smaller than the width of the housing webs between adjacent housing channels, so that during rotation of the heat exchange roller there is always at least one radial web in the region of each housing web. The two cylinders which radially delimit the roller wall may consist of apertured sheet metal 54 and be surrounded by a fine-mesh wire fabric 56 (FIG. 6) which covers the flow-through openings 55. Alternatively thereto the cylinders receiving the heat carrier material between them may each consist of a coarse grid mat 57 of intersecting longitudinal and transverse wires which produces the cylinder shape, and a fine-mesh wire fabric 58 surrounding the mat (FIG. 7). Another possibility consists in the construction of the roller wall from granulate 60 which is sintered together to assume cylinder shape (FIG. 8).

Still another possibility consists in the construction of the roller wall from lamellas. These may be lamellas 61 extending lengthwise of the roller in form of elongated sheet metal strips, which are arranged with spacing under formation of radial flow-through gaps (FIG. 9), or circular disk lamellas 62 which may e.g. be received on carrying bolts extending in longitudinal direction of the roller (FIG. 10). In use of lamellas or heat carrier material it has been found advantageous to provide surface changes 64 (FIG. 11) in the region of the radially directed flow-through gaps, for example in form of embossments or deformations extending at right angles to the lamella plane.

I claim:

1. Regenerator with a hollow cylindrical heat exchange roller turning about an axis of rotation, within a housing said heat exchange roller having a jacket of heat carrier material for flow through by a flow medium emitting heat and a flow medium receiving heat, said heat carrier material comprising lamellas arranged in the roller wall to form radial flow-through gaps, said housing having a partition wall within the roller for providing separate flow regions, said flow media passing twice through said regions by substantially radial passages through said jacket transverse to the axis of rotation of said heat exchange roller, channel stubs connected to said housing, said channel stubs being shaped so that said flow media is continuously deflected in the channel stubs in flow direction for producing substantially low flow resistance to and from the housing, said housing being fully symmetrical relative to the axis of rotation of said heat exchange roller, said housing having four channel stub which are each angularly displaced from adjacent channel stubs by 90°, each two of said channel stubs forming inflow channels and outflow channels at each side of, said stubs terminating at said jacket at separated regions, said partition wall dividing the interior of said heat exchange roller into two symmetrical regions and being comprised of walls having cylindrically shaped portions, said inflow channels and outflow channels lying on opposite ones of said regions for radially guiding flow through said heat exchange roller, said connecting stubs being shaped to guide said flout media radially onto said heat exchange roller, system channels connectable to said stubs for supplying and removing flow media, two system channels for supplying and removing one flow medium being connectable in alignment and two other system channels for guiding the other flow medium extending at right angles to one another; said system channels forming a rectangular-shaped cross with the housing exterior side, said system channels corresponding to peripheral geometry and flow cross-section of all channel stubs.

2. Regenerator as defined in claim 1, wherein said channel stubs are bordered in mouth region at the heat exchange roller by substantially radially extending guide walls.

3. Regenerator as defined in claim 1, wherein said housing has a cross-section with a substantially quadratic-shaped periphery.

4. Regenerator as defined in claim 1, wherein two channel stubs for inflow channels lying diametrically opposite one another, two channel stubs for outflow channels also lying diametrically opposite one another.

5. Regenerator as defined in claim 1, wherein said housing has an axial length which is large in relation to the diameter of said heat exchange roller, said channel stubs having a depth extending over substantially the entire axial length of said housing.

6. Regenerator as defined in claim 1 including bearings and rotational drive for said heat exchange roller arranged outside regions contacted by the flow media.

* * * * *